US008083899B2

(12) United States Patent
Kawamata

(10) Patent No.: US 8,083,899 B2
(45) Date of Patent: Dec. 27, 2011

(54) BELT FOR SHOE PRESS

(75) Inventor: Tomoyuki Kawamata, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 430 days.

(21) Appl. No.: 12/303,175

(22) PCT Filed: Jun. 4, 2007

(86) PCT No.: PCT/JP2007/061269
§ 371 (c)(1),
(2), (4) Date: Dec. 2, 2008

(87) PCT Pub. No.: WO2007/142176
PCT Pub. Date: Dec. 13, 2007

(65) Prior Publication Data

US 2009/0250184 A1 Oct. 8, 2009

(30) Foreign Application Priority Data

Jun. 5, 2006 (JP) ..... 2006-155612

(51) Int. Cl.
*D21F 3/02* (2006.01)

(52) U.S. Cl. ..... 162/358.4; 162/901

(58) Field of Classification Search ..... 162/306, 162/358.4, 901; 428/163, 167; 442/59, 148
See application file for complete search history.

(56) References Cited

U.S. PATENT DOCUMENTS 4,229,254 A * 10/1980 Gill ..... 162/358.4
4,238,287 A * 12/1980 Gill ..... 162/358.4
5,943,951 A 8/1999 Muellner
6,116,156 A * 9/2000 Schiel et al. ..... 100/118
6,932,888 B2 * 8/2005 Matuschczyk et al. .... 162/358.4
7,185,757 B2 * 3/2007 Ishino et al. ..... 162/358.4
2004/0112561 A1 * 6/2004 Watanabe et al. ..... 162/358.3

FOREIGN PATENT DOCUMENTS

JP 2005-307421 A1 11/2005
WO WO 02/48456 A1 6/2002
WO WO 02/090649 A1 11/2002
WO WO 2005/024128 A1 3/2005

OTHER PUBLICATIONS

International Search Report for International Application No. PCT/JP2007/061269 dated Aug. 14, 2007.

* cited by examiner

*Primary Examiner* — Eric Hug
(74) *Attorney, Agent, or Firm* — Kratz, Quintos & Hanson, LLP

(57) ABSTRACT

A belt (4) for a shoe press is disposed for rotational movement between a press roll (2) and a shoe (3). The belt (4) includes a shoe-side layer (21), a base layer (22) disposed on an outer circumferential surface of the shoe-side layer (21), and a wet paper web-side layer (25) disposed on an outer circumferential surface of the base layer (22). The base layer (22) has a pair of reinforcing bases (11). The reinforcing layers (11) are disposed circumferentially in a warpwise direction in given regions (E1) corresponding respectively to shoe edges (10) on the opposite sides in a widthwise direction of the shoe (3). The rigidity of belt portions of shoe edge abutment regions (E1) on opposite sides in the widthwise direction of the shoe (3) is partially increased to increase bending stresses and crack resistance of the belt.

13 Claims, 14 Drawing Sheets

(A)

(B)

BELT FOR SHOE PRESS

TECHNICAL FIELD

The present invention relates to a belt for shoe press for used in a shoe press mechanism for papermaking.

BACKGROUND ART

Papermaking machines for removing water from paper material comprise a wire part, a press part and a drier part. The wire part, the press part and the drier part are arranged in the order named along the direction in which a wet paper web is fed.

The press part includes a press comprising a plurality of press mechanisms arranged in series along the direction in which the wet paper web is fed.

In the papermaking machine, the wet paper web is successively transferred to and fed by wet paper web feed belts, which are disposed respectively in the wire part, the press part and the drier part and are made of water absorbing felt. The wet paper web is pressed by the press mechanisms of the press part to squeeze water therefrom, and then is dried in the drier part.

The press mechanisms include a roll press mechanism and a shoe press mechanism. The roll press mechanism is a mechanism having rolls for sandwiching and pressing wet paper web feed belts which hold the wet paper web. The shoe press mechanism is a mechanism having a press roll and a shoe for sandwiching and pressing wet paper web feed belts which hold the wet paper web.

The shoe press mechanism has a pressing section (nipping section) having a greater pressing zone than the roll press mechanism. As a result, the shoe press mechanism is advantageous in that it has a longer pressing time for a better water squeezing capability, and hence has been finding wide use in recent years.

The present applicant has proposed a shoe press belt for use in shoe press mechanisms (Japanese laid-open patent publication No. 2005-307421). The shoe press belt is an endless belt comprising a base layer, a wet paper web-side layer and a shoe-side layer, and is disposed for rotational movement between the press roll and the shoe of the shoe press mechanism.

The shoe press belt disclosed in Japanese laid-open patent publication No. 2005-307421 and other general shoe press belts are disposed between the press roll and the shoe of the shoe press mechanism, and runs in the warpwise direction (MD direction: rotational direction) with the belt having a shoe abutment surface held in contact with the upper surface of the shoe.

The dimension (belt weftwise dimension) of the shoe press belt in the widthwise direction (CMD direction) thereof is greater than the dimension (shoe weftwise dimension) of the shoe in the widthwise direction thereof. The shoe press belt is driven to run by the power transmitted through the wet paper web feed belt as the press roll is actuated. As a result, when the shoe press belt moves through the pressing section, it is subjected to a shearing stress (a type of bending stress).

Consequently, there has been a demand for a technology for preventing the shoe press belt from cracking (particularly cracking in the warpwise direction) due to fatigue even when the shoe press belt undergoes repetitive bending deformation in the pressing section over a long period of time.

Patent document 1: Japanese laid-open patent publication No. 2005-307421

The present invention has been made in efforts to solve the above problems. It is an object of the present invention to provide a belt for a shoe press which has belt portions in predetermined regions corresponding respectively to shoe edges on opposite sides in the widthwise direction of a shoe. The belt portions are partially increased in rigidity to increase the bending stress and crack resistance of the belt for suppressing bending deformations and for preventing the belt from cracking for improved durability.

DISCLOSURE OF THE INVENTION

To achieve the above object, a belt according to the present invention is a belt for a shoe press adapted to be disposed for rotational movement between a press roll of a shoe press mechanism and a shoe above or below the press roll. The belt for the shoe press comprises a shoe-side layer held in contact with the shoe, a base layer disposed on an outer circumferential surface of the shoe-side layer, and a wet paper web-side layer disposed on an outer circumferential surface of the base layer. The base layer has a pair of reinforcing bases. The reinforcing bases are disposed circumferentially in a warpwise direction in given regions corresponding respectively to shoe edges on the opposite sides in a widthwise direction of the shoe.

For example, the reinforcing bases are disposed on one or both of the outer and inner circumferential surfaces of the base layer.

According to an example, the reinforcing bases are disposed in only shoe edge abutment regions held in abutment against the shoe edges of the belt for a shoe press. According to another example, the reinforcing bases are disposed in both shoe edge abutment regions held in abutment against the shoe edges of the belt for a shoe press and end regions including ends in a weftwise direction of the belt for a shoe press.

Preferably, the wet paper web-side layer has a plurality of grooves defined in the warpwise direction in a surface thereof, and the grooves have a curved cross-sectional shape. According to an example, of the grooves defined in the belt, the grooves positioned in the vicinity of the shoe edges have a curved cross-sectional shape, or all the grooves have a curved cross-sectional shape. According to another example, the grooves defined in the warpwise direction in the surface of the wet paper web-side layer of the belt are not defined in shoe edge abutment regions on the opposite sides in the widthwise direction of the shoe, but are defined in portions other than the regions.

Preferably, the reinforcing bases comprise grid members made up of warp yarns and weft yarns arranged in a grid pattern and joined to each other at crossings. The base layer comprises a main body comprising a grid member made up of warp yarns and weft yarns arranged in a grid pattern and joined to each other at crossings, the reinforcing bases comprising the grid members, and a yarn-wound layer disposed on an outer or inner circumferential surface of the grid members and made up of a helically wound yarn.

Preferably, the reinforcing bases employ grid members which are identical to or are different from the grid member of the main body of the base layer.

The grid member of the main body and the grid members of the reinforcing bases are different from each other in a first case wherein the grid members have different meshes, a second case wherein the grid members have warp yarns of different thicknesses, a third case wherein the grid members have weft yarns of different thicknesses, and a combination of two of the first through third cases.

Preferably, the grid members are disposed in a plurality of layers, and portions in which the ends in the widthwise direction of the grid members overlap each other or portions, in which the ends are spaced from each other or are held in abutment against each other, are not disposed in the same position across the layers.

Preferably, the weft yarns of the grid members are less liable to wear than the warp yarns thereof. The warp yarns comprise twisted yarns or spun yarns made of inorganic fiber such as carbon fiber, glass fiber, or the like, or natural fiber such as cotton, or synthetic fiber. The weft yarns comprise twisted yarns of synthetic fiber having a high modulus and a high coefficient of elasticity such as of nylon, polyethylene terephthalate, aromatic polyamide, aromatic polyimide, high-strength polyethylene, or the like, or polyester multifilament, or spun yarns of polyester cotton.

The synthetic fiber is made of polyester cotton, polyester multifilament, acrylic cotton, or acrylic multifilament.

The belt for a shoe press according to the present invention is constructed as described above. Therefore, the rigidity of the belt portions in the given regions corresponding respectively to the shoe edges on the opposite sides in the widthwise direction of the shoe is partially increased. As a result, the belt has an increased bending stress and increased crack resistance to suppress bending deformations and to prevent itself from cracking for improved durability.

BRIEF DESCRIPTION OF THE DRAWINGS

FIG. 1 is a perspective view showing a general structure of a shoe press mechanism;

FIGS. 2 through 11 are views illustrative of an embodiment of the present invention. FIG. 2 is a cross-sectional view of the shoe press mechanism;

FIG. 3 is an enlarged view of a portion III of FIG. 2, showing a cross section of a belt for a shoe press;

FIG. 4 is an enlarged partial view of a grid member of the belt for the shoe press;

FIG. 5 is a view illustrative of a process for manufacturing the belt for the shoe press;

FIG. 6 is a set of views showing step 1 of forming a shoe-side layer, and FIGS. 6(A), 6(B) are a side elevational view and a perspective view, respectively;

FIG. 7 is a view showing step 2 of providing a base layer, and FIG. 7 is a perspective view showing a step of placing the grid member in step 2;

FIG. 8 is a perspective view showing a step of providing a reinforcing base in step 2;

FIG. 9 is a perspective view showing a step of forming a yarn-wound layer in step 2;

FIG. 10 is a perspective view showing a step of joining the formed yarn-wound layer in step 2;

FIG. 11 is a front elevational view showing a step of separating the belt for the shoe press from a mandrel;

FIG. 12 is a cross-sectional view corresponding to FIG. 3, and shows a belt for a shoe press according to a first modification;

FIG. 13 is a cross-sectional view corresponding to FIG. 2, and shows a shoe press mechanism employing a belt for a shoe press according to a second modification;

FIG. 14 is a cross-sectional view corresponding to FIG. 3, and shows a belt for a shoe press according to a third modification;

FIG. 15 is a cross-sectional view corresponding to FIG. 3, and shows a belt for a shoe press according to a fourth modification;

FIG. 16 is a schematic view of an experimental apparatus for checking crack resistance and wear property; and FIG. 17 is a schematic view of an experimental apparatus for checking bending stresses.

BEST MODE FOR CARRYING OUT THE INVENTION

Belts for shoe presses according to the present invention will be described below.

Figure 1:
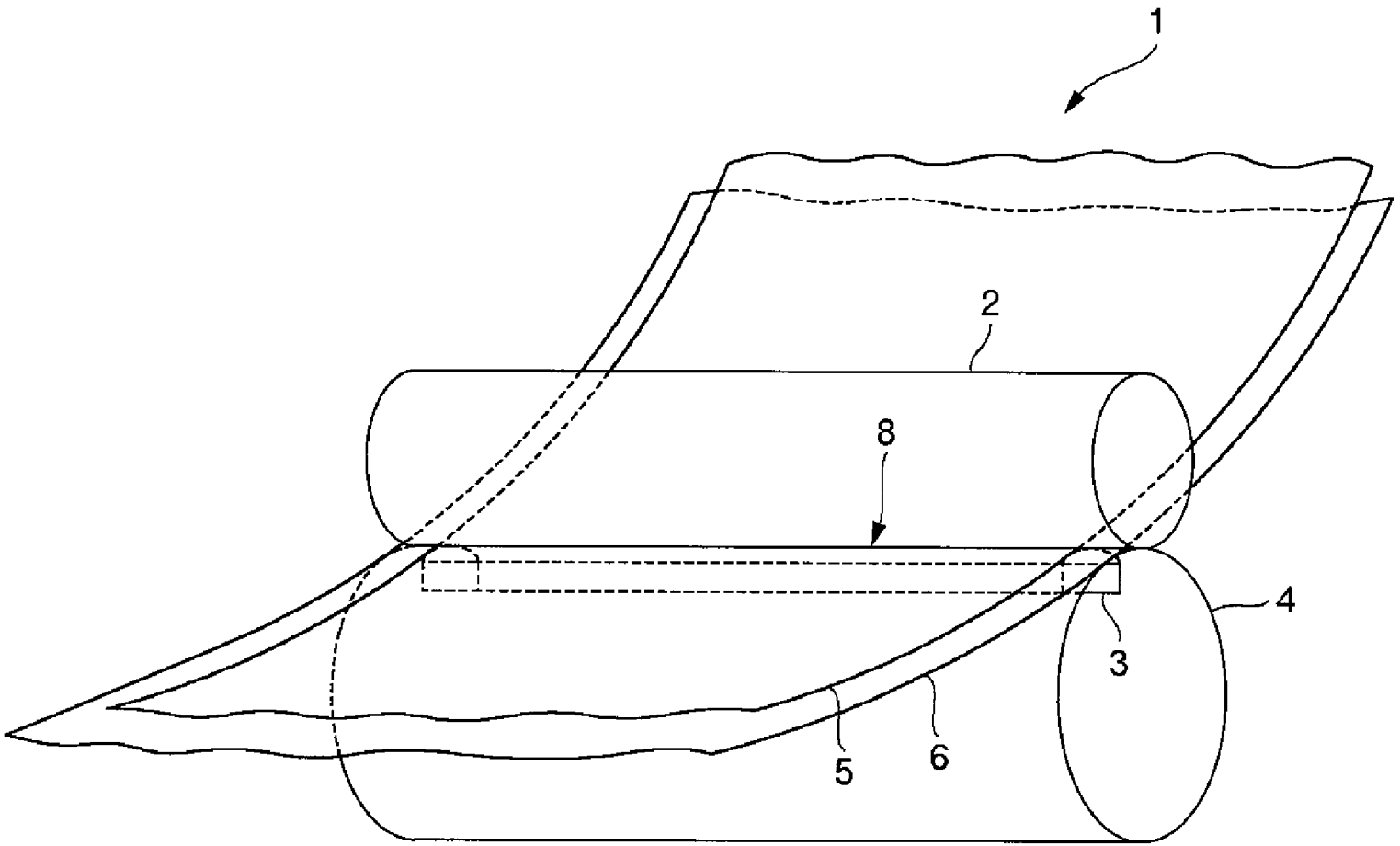
FIGS. 1 through 17 are views illustrative of the present invention.
Figure 2:
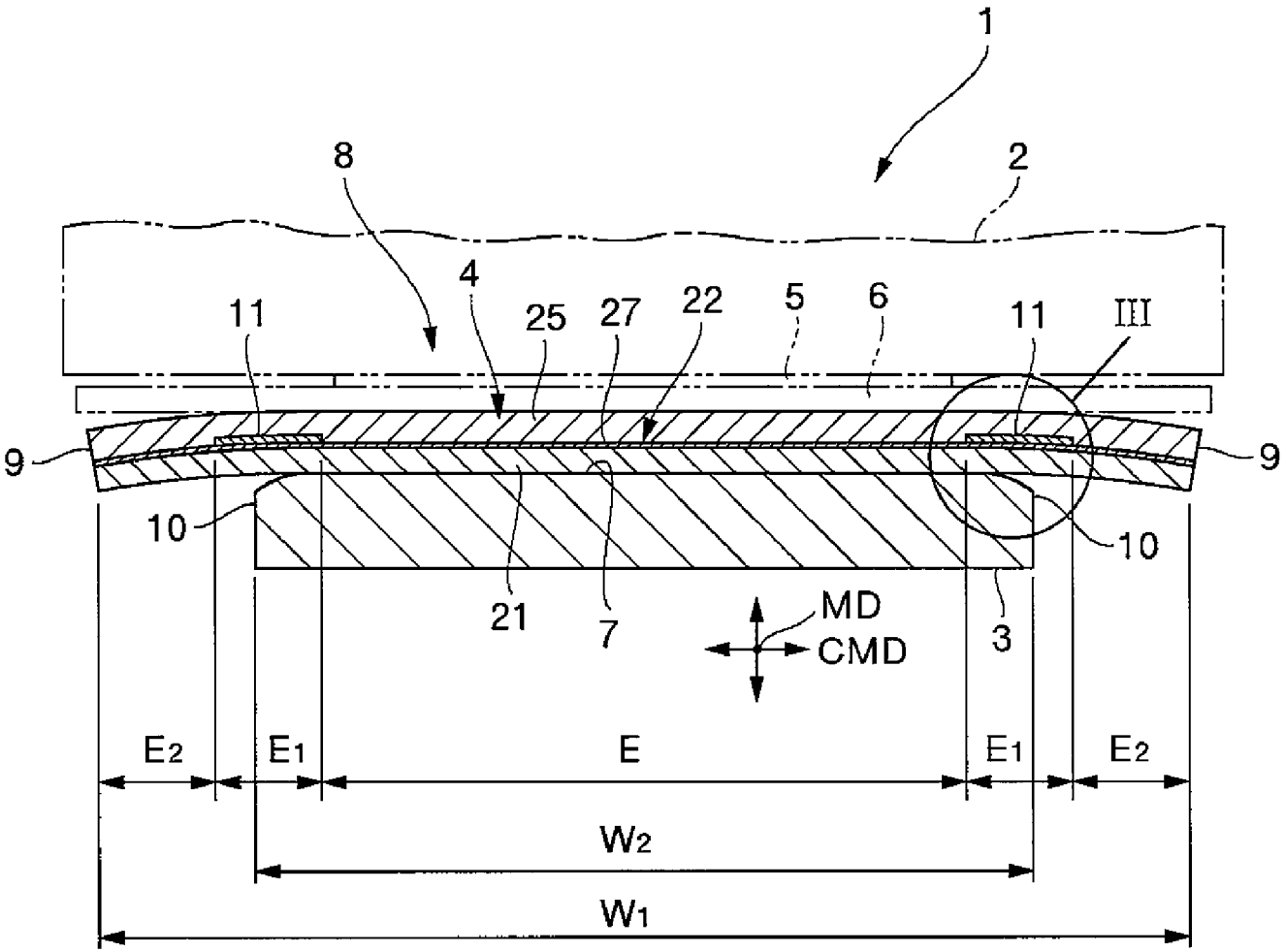
Figure 3:
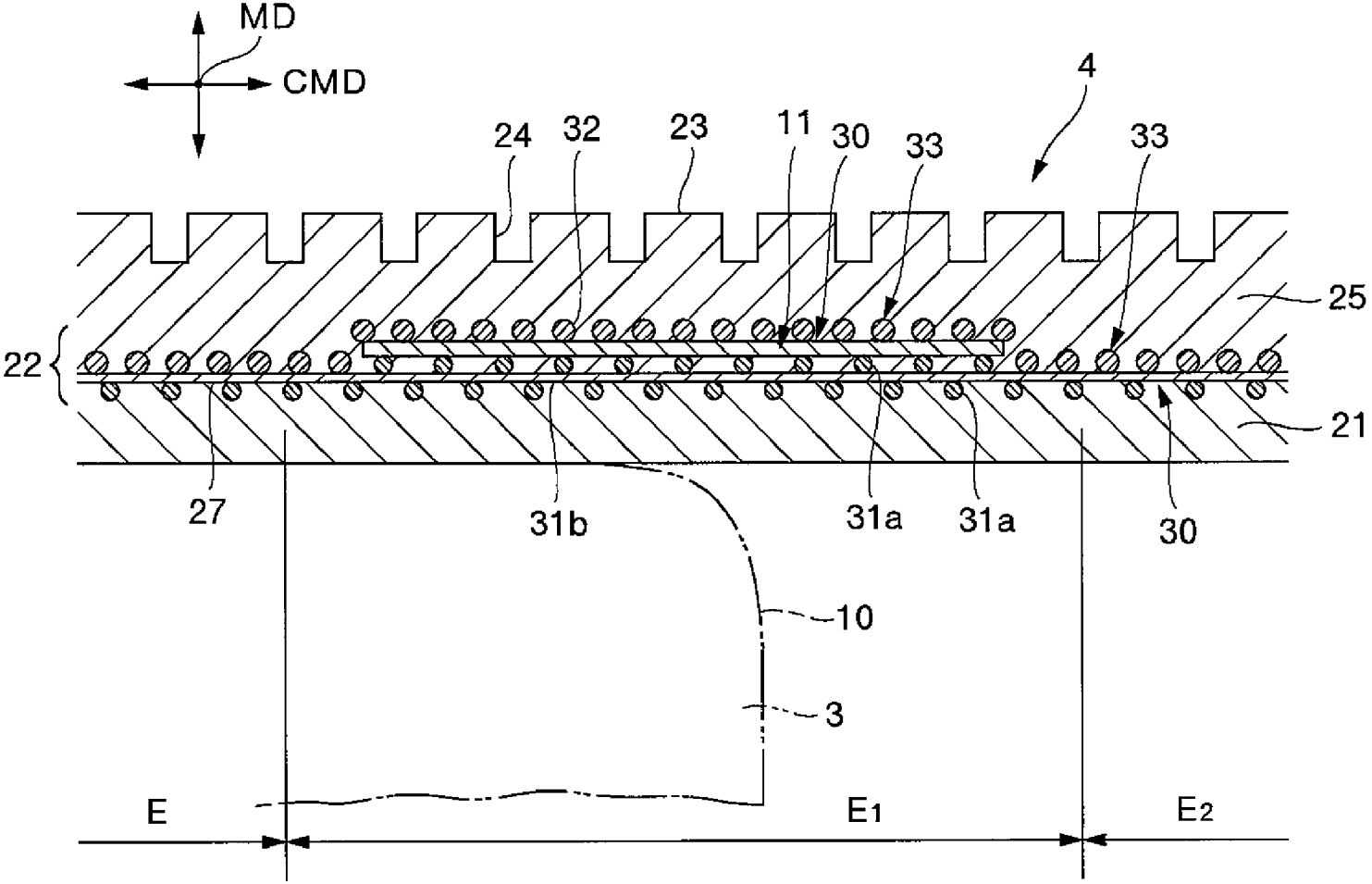

FIGS. 1 through 17 are views illustrative of the present invention. FIG. 1 is a perspective view showing a general structure of a shoe press mechanism. FIGS. 2 through 11 are views illustrative of an embodiment of the present invention. FIG. 2 is a cross-sectional view of the shoe press mechanism. FIG. 3 is an enlarged view of a portion III of FIG. 2, and shows a cross section of a belt for a shoe press.

As shown in FIGS. 1 through 3, a shoe press mechanism 1 comprises a press roll 2 and a shoe 3 disposed below (or above) the press roll 2. A belt 4 for a shoe press (hereinafter referred to as "belt 4") is disposed for rotational movement between the press roll 2 and the shoe 3. A plurality of shoe press mechanisms 1 are arranged in series along the direction in which a wet paper web 5 is fed, thereby providing a press part of a papermaking machine.

The shoe press mechanism 1 employs the endless belt 4 movably disposed between the press roll 2 and the shoe 3. The shoe press mechanism 1 may be an open-type shoe press mechanism with the belt 4 being wound around a plurality of rolls or a press-sleeve-type shoe press mechanism with the belt 4 being guided and supported by a hollow guide shell.

A wet paper web feed belt 6 made of water absorbing felt and the wet paper web 5 supported thereon are fed in the same direction at substantially the same speed. In a pressing section (nipping section) 8, the wet paper web 5 is positioned on the belt 4 and pressed by the press roll 2 and the shoe 3. As a result, water in the wet paper web 5 is squeezed and absorbed by the wet paper web feed belt 6, and part of the water flows through grooves 24 in the belt 4 and is discharged out.

The belt 4 is used in the press-sleeve-type shoe press mechanism. The belt 4 is subject to stricter conditions such as a higher papermaking rate, a higher nipping pressure in the pressing section 8, and a greater number of nipping actions than a belt used in the open-type shoe press mechanism. Therefore, the belt 4 is strongly required to have increased durability by the user.

In the pressing section 8, the belt 4 is positioned between an upper surface 7 of the shoe 3 and the wet paper web feed belt 6 which supports the wet paper web 5, and is run in the warpwise direction (MD direction). The dimension (belt weftwise dimension W1) of the belt 4 in the widthwise direction (the weftwise direction: CMD direction) thereof is greater than the dimension (shoe weftwise dimension W2) of the shoe 3 in the widthwise direction (weftwise direction) thereof.

Therefore, the belt 4 has its opposite weftwise ends 9 extending outwardly, and is held in contact with the upper surface 7 of the shoe 3 from one shoe edge 10 in the weftwise direction to the other shoe edge 10 in the weftwise direction.

As a result, the belt 4 can be divided into a central region E, a pair of shoe edge abutment regions E1 positioned outwardly of the central region E, and a pair of end regions E2. The end regions E2 are positioned outwardly of the shoe edge abutment regions E1 and include the weftwise ends 9 of the belt 4.

In the central region E1, the belt 4 is held in contact with the upper surface 7 of the shoe 3. The shoe edges 10 are positioned in the shoe edge abutment regions E1. The belt 4 in the region E1 is held in contact with the upper surface 7 of the shoe 3 toward the center from the shoe edges 10, but is not held in contact with the upper surface 7 outside of the shoe edges 10. As the shoe 3 is not present in the end regions E2, the belt 4 is not held in contact with the shoe 3 in the regions E2.

The belt 4 comprises a shoe-side layer 21 held in contact with the shoe 3, a base layer 22 disposed on an outer circumferential surface of the shoe-side layer 21, and a wet paper web-side layer 25 disposed on an outer circumferential surface of the base layer 22. The wet paper web-side layer 25 has a plurality of grooves 24, for discharging water, which are defined in a surface 23 thereof and extend in the warpwise direction (the MD direction). The wet paper web-side layer 25 may alternatively have no grooves.

The base layer 22 has a pair of reinforcing bases 11. The reinforcing bases 11 are disposed in given regions (in the present embodiment, the shoe edge abutment regions E1) corresponding respectively to the shoe edges 10 on the opposite sides in the widthwise direction of the shoe 3, and extend circumferentially in the warpwise direction (the MD direction).

Since the belt 4 has the reinforcing bases 11, the rigidity of the belt portions in the given regions (in the present embodiment, the shoe edge abutment regions E1) corresponding respectively to the shoe edges 10 on the opposite sides in the widthwise direction of the shoe 3 is partially increased.

Consequently, the belt 4 has an increased bending stress to suppress bending deformations and also has increased crack resistance to prevent itself from cracking (particularly cracking in the warpwise direction) for improved durability.

The reinforcing bases 11 are disposed on one or both of an outer circumferential surface (on the side of the press roll 2) and an inner circumferential surface (on the side of the shoe 3) of the base layer 22 (in the present embodiment, the outer circumferential surface). The reinforcing bases 11 should preferably be disposed on the outer circumferential surface of the base layer 22 as with the present embodiment.

Specifically, when the wet paper web-side layer 25 is to be formed on the outer circumferential surface of the base layer 22, the reinforcing bases 11 have been wound and supported circumferentially on the base layer 22. Therefore, the wet paper web-side layer 25 can be stably formed on the outer circumferential surface of the base layer 22. If the grooves 24 are formed in the wet paper web-side layer 25 within the shoe edge abutment regions E1 held in abutment against the shoe edges 10, the bottoms of those grooves 24 are spaced a small distance from the reinforcing bases 11. For crack resistance, therefore, the depth of the grooves in the regions E1 needs to be smaller than the depth of the grooves in the central region E.

The reinforcing bases 11 are disposed only in the shoe edge abutment regions E1, of the belt 4, which are held in abutment against the shoe edges 10. Since the rigidity of the belt portions in the shoe edge abutment regions E1 of the belt 4 is thus partially increased, the belt 4 is increased in bending stress and crack resistance.

According to a modification, the reinforcing bases 11 are disposed on the inner circumferential surface of the base layer 22 to keep the grooves in the shoe edge abutment regions E1 and the grooves in the central region E as deep as each other.

According to another modification, the reinforcing bases 11 are disposed on both the outer and inner circumferential surfaces of the base layer 22 to further partially increase the rigidity of the belt portions in the shoe edge abutment regions E1 corresponding respectively to the shoe edges 10 on the opposite sides in the widthwise direction of the shoe. Therefore, the belt 4 is further increased in bending stress and crack resistance.

Figure 4:
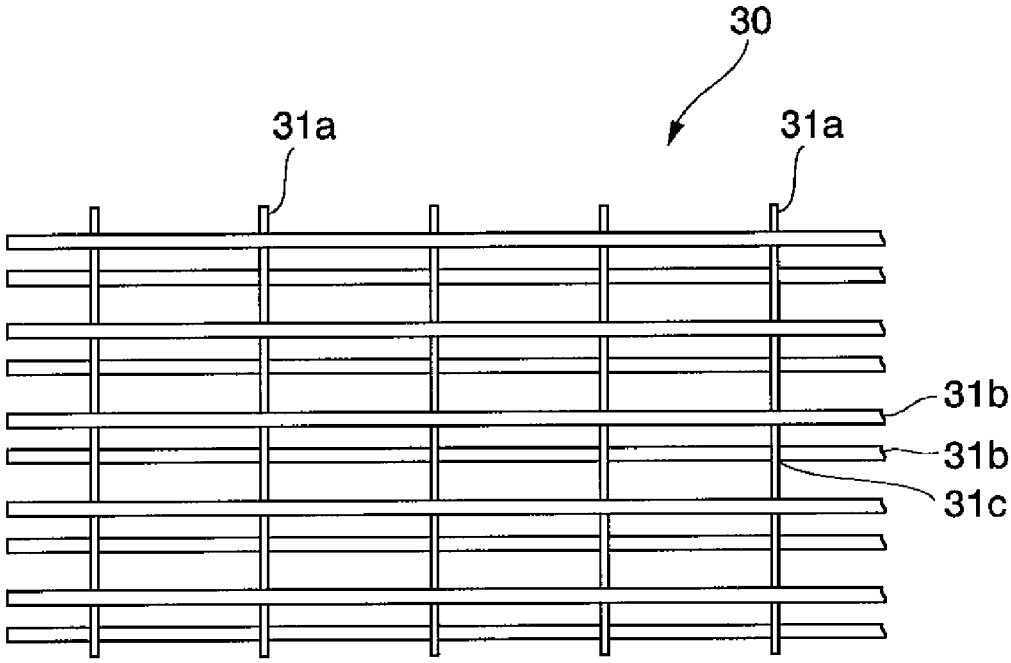

FIG. 4 is an enlarged partial view of a grid member 30 of the belt 4.

As shown in FIGS. 3 and 4, the reinforcing bases 11 comprise grid members 30 made up of a grid-shaped combination of a plurality of warp yarns 31*a* and a plurality of weft yarns 31*b*. In the grid members 30, the warp yarns 31*a* and the weft yarns 31*b* lie over and under each other in a grid pattern and are joined to each other at crossings 31*c*. However, the grid members 30 are not of a woven structure.

Prior to attachment, the grid member 30 is in the form of a roll of a terminated web having a width in the range from 0.5 m to 1.0 m. For attachment, the terminated grid member 30 is reeled out straight from the roll, and arranged as a plurality of juxtaposed webs spaced along the axis of a mandrel M.

The base layer 22 comprises a main body 27 made up of a grid member 30, a reinforcing base 11 made up of a grid member 30, and a yarn-wound layer 33 disposed on the outer circumferential surface of the grid member 30 and made up of a helically wound yarn 32.

The reinforcing base 11 and the main body 27 may be made up of an endless woven fabric. According to the present embodiment, however, the reinforcing base 11 and the main body 27 are made up of the grid member 30 with the joined crossings 31*c* of the warp yarns 31*a* and the weft yarns 31*b*. Consequently, even if stresses concentrate on the crossings 31*c* of the grid member 30 when the belt 4 is in use, the belt 4 is less liable to crack and hence has increased crack resistance.

Since the crossings 31*c* are joined, the warp yarns 31*a* and the weft yarns 31*b* are not displaced when the grid member 30 is attached at the time the belt 4 is manufactured. As a result, the grid member 30 can easily be attached with good efficiency.

In the grid member 30, the weft yarns 31*b* are less liable to wear than the warp yarns 31*a*. When the belt 4 is used for a long period of time, the joined crossings 31*c* of the warp yarns 31*a* and the weft yarns 31*b* of the grid member 30 are likely to be peeled off, causing wear between the warp yarns 31*a* and the weft yarns 31*b*. Since the weft yarns 31*b* are less liable to wear than the warp yarns 31*a*, however, the weft yarns 31*b* do not wear easily, resulting in increased mechanical strength of the belt 4 and increased dimensional stability thereof in the weftwise direction.

Figure 5:
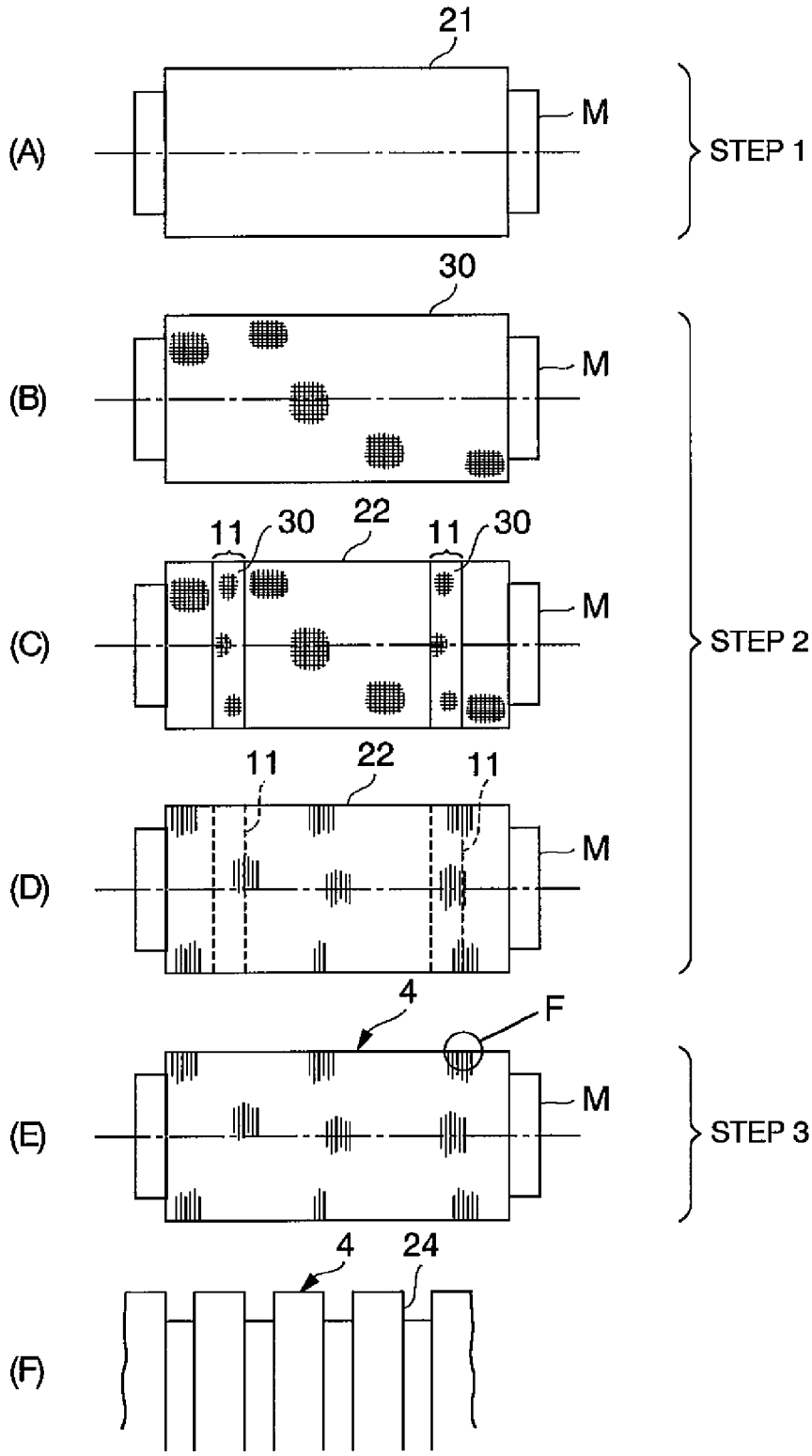
Figure 6:
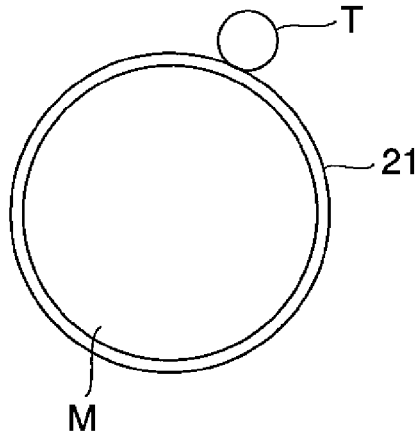
Figure 6:
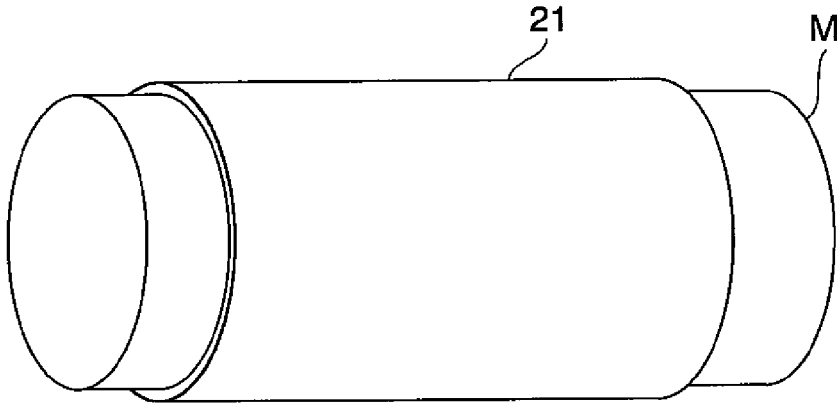

FIG. 5 is a view illustrative of a process for manufacturing the belt 4. FIG. 5(F) is an enlarged view of a portion F shown in FIG. 5(E). FIG. 6 is a set of views showing step 1 of forming the shoe-side layer 21, and FIGS. 6(A), 6(B) are a side elevational view and a perspective view, respectively.

Figure 7:
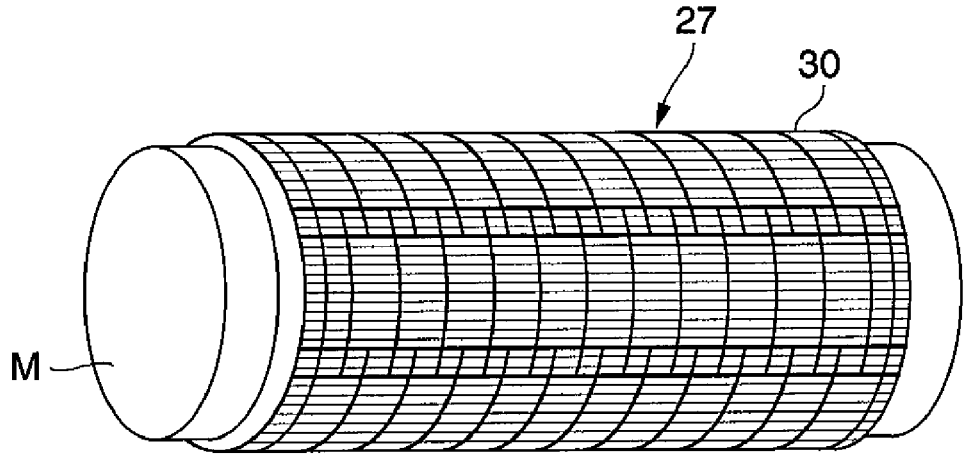
Figure 8:
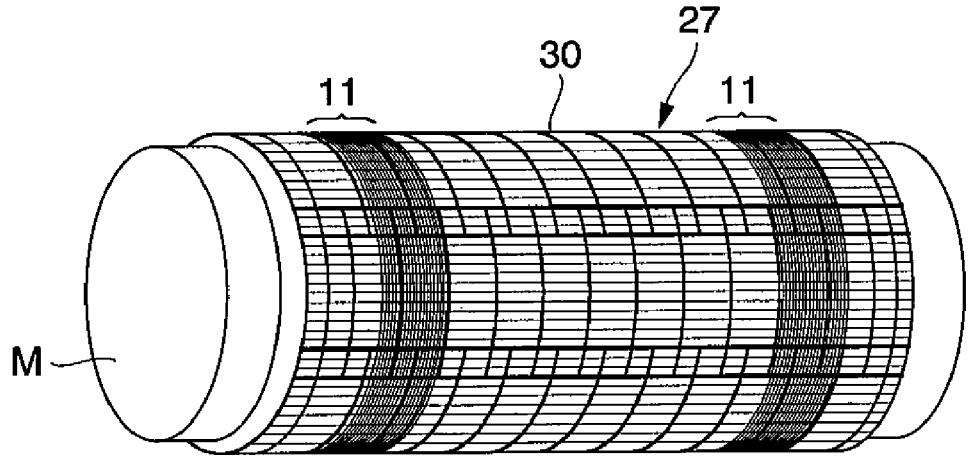

FIG. 7 is a view showing step 2 of providing the base layer 22, and FIG. 7 is a perspective view showing a step of placing the grid member 30 in step 2. FIG. 8 is a perspective view showing a step of providing the reinforcing base 11 in step 2.

Figure 9:
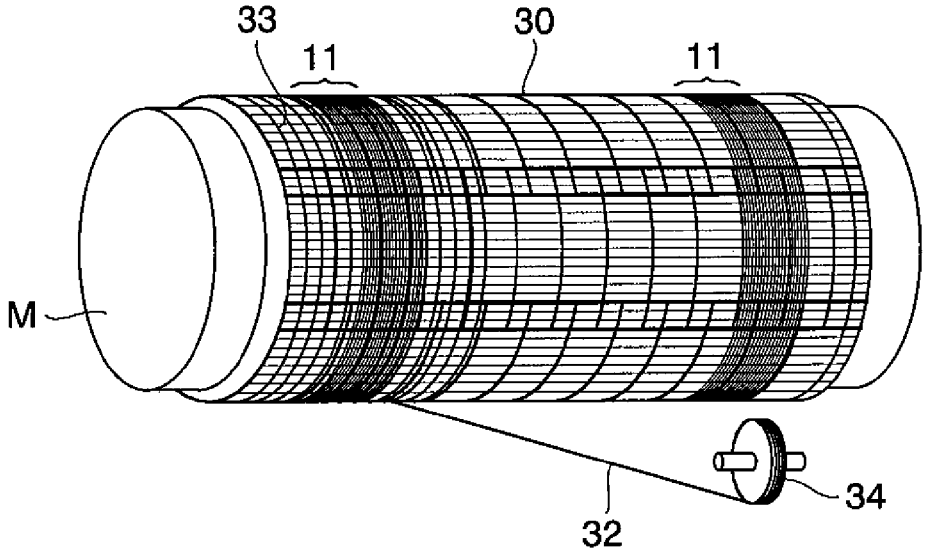
Figure 10:
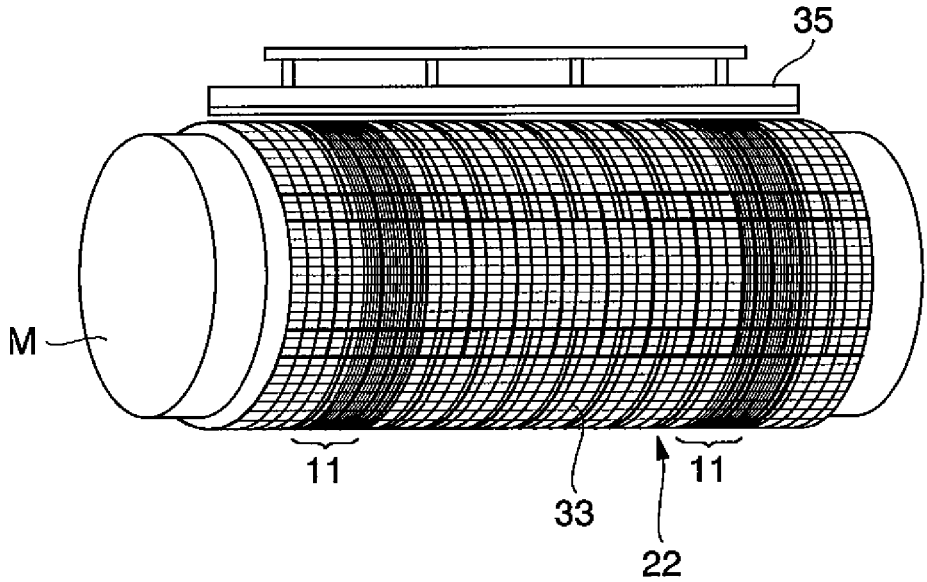
Figure 11:
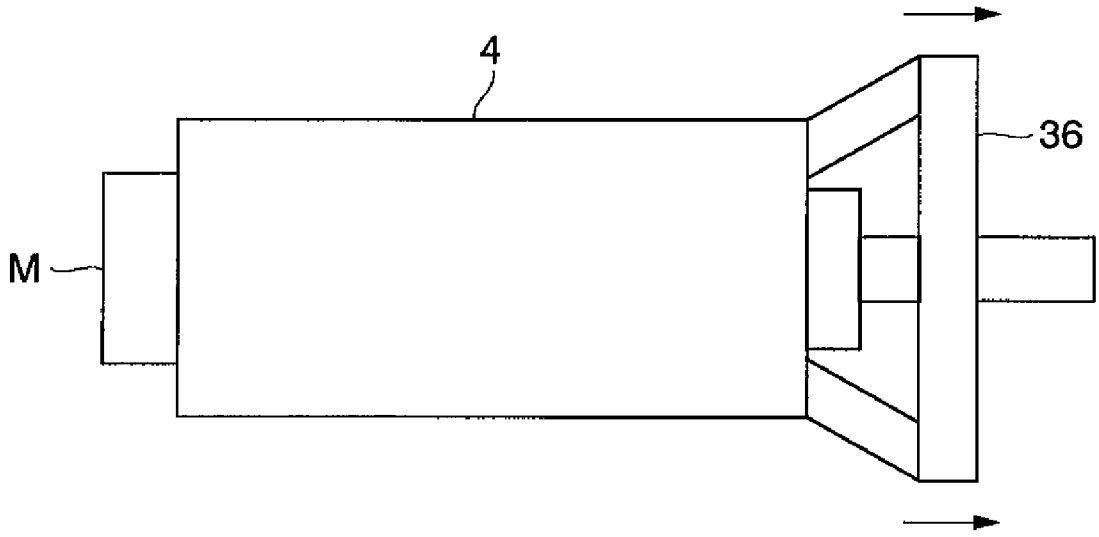

FIG. 9 is a perspective view showing a step of forming yarn-wound layer 33 in step 2. FIG. 10 is a perspective view showing a step of joining the formed yarn-wound layer 33 in step 2. FIG. 11 is a front elevational view showing a step of separating the belt 4 from the mandrel M.

For manufacturing the belt 4, the mandrel M is used to form the shoe-side layer 21, the base layer 22 and the wet paper web-side layer 25 in the order named.

First, as shown in FIG. 5(A) and FIG. 6, in step 1, the shoe-side layer 21 is formed on a polished surface of the mandrel M. The surface of the mandrel M should be coated with a release agent or a release sheet should be applied to the surface of the mandrel M in advance. The shoe-side layer 21 is formed to a thickness ranging from 0.5 to 2.0 mm using an applicator (e.g., a doctor bar, a coater bar, or the like) T.

The polished surface of the mandrel M keeps smooth the shoe-side layer 21, of the belt 4, which runs at all times in forced contact with the shoe 3 (see FIG. 1). In addition, the polished surface of the mandrel M allows the manufactured belt 4 to be easily released from the mandrel M. The mandrel M should preferably be combined with a heating device for accelerating the curing of the resin of the shoe-side layer 21.

Then, the base layer 22 is formed on the outer circumferential surface of the shoe-side layer 21 in step 2 shown in FIGS. 5(B) through 5(D) and FIGS. 7 through 10. As shown in FIGS. 5(B) and 7, the grid member 30 (FIG. 4) is attached to outer circumferential surface of the shoe-side layer 21.

The crossings 31*c* of the grid member 30 have been joined by resin bonding or a melting process. The weft yarn 31*b* of the grid member 30 should preferably be made of a material which is less liable to wear than the warp yarns 31*a*.

The warp yarns 31*a* comprise various yarns such as twisted yarns or spun yarns made of inorganic fiber such as carbon fiber, glass fiber, or the like, or natural fiber such as cotton, or synthetic fiber. The synthetic fiber may be made of polyester cotton, polyester multifilament, acrylic cotton, acrylic multifilament, or the like.

The weft yarns 31*b* comprise twisted yarns of synthetic fiber having a high modulus and a high coefficient of elasticity such as of nylon, PET (polyethylene terephthalate), aromatic polyamide, aromatic polyimide, high-strength polyethylene, or the like, or polyester multifilament, or spun yarns of polyester cotton.

The grid of the grid member 30 should preferably have a mechanical strength in the range from 50 to 250 kg/cm, and a 1% modulus in the range from 5 to 40 kg/cm.

As shown in FIGS. 5(B) and 7, one or plural webs of grid members 30 are disposed around the outer circumferential surface of the shoe-side layer 21 on the mandrel M, forming the main body 27 of the base layer 22.

For placing plural grid members 30, the roll of a terminated web having a width in the range from 0.5 m to 1.0 m referred to above is used. For attachment, the terminated grid member 30 is reeled out straight from the roll, and severed successively into given lengths (lengths each identical to the width of the belt 4) corresponding to the width of the belt 4, producing plural grid members 30.

For increasing the mechanical strength of the belt 4, the grid members 30 should preferably be disposed around the outer circumferential surface of the shoe-side layer 21 such that the weft yarns 31*b* of the web-like grid members 30 extend along the axis of the mandrel M and the ends in the widthwise direction of the grid members 30 overlap each other (FIG. 7).

The ends in the widthwise direction of the grid members 30 may be space from each other or may be held in abutment against each other. Alternatively, one or plural webs of grid members 30 may be spirally wound around the outer circumferential surface of the shoe-side layer 21. In such a case, the ends in the widthwise direction of the grid members 30 may be arranged to overlap each other for increased mechanical strength of the belt 4.

For placing the grid member 30 around the outer circumferential surface of the shoe-side layer 21, the mandrel M is rotated slowly and the weft yarns 31*b* are arranged to extend along the axis of the mandrel M before the shoe-side layer 21 is completely cured.

Then, as shown in FIGS. 6(C) and 8, the grid member 30 is superposed on the outer circumferential surface of the main body 27 of the base layer 22 to provide a pair of reinforcing bases 11. The reinforcing bases 11 are disposed in the shoe edge abutment regions E1 (FIG. 2). The reinforcing bases 11 comprise a grid member 30 which is the same as (or different from) the main body 27 of the base layer 22. The grid member 30 of the reinforcing bases 11 may be different from the grid member 30 of the main body 27 in a first case wherein their grid members 30 have different meshes, a second case wherein their grid members 30 have warp yarns 31*a* of different thicknesses, a third case wherein their grid members 30 have weft yarns 31*b* of different thicknesses, and a combination of two of the first through third cases.

For producing the reinforcing bases 11, one or plural webs of grid members 30 are disposed around the outer circumferential surface of the main body 27 of the base layer 22 in given positions in the shoe edge abutment regions E1 such that the weft yarns 31*b* are oriented in the axial direction of the mandrel M. To increase the mechanical strength of the belt 4, a plurality of webs of reinforcing bases 11 are wound circumferentially a plurality of times in the warpwise direction.

In this manner, the pair of reinforcing bases 11 are disposed and overlapped circumferentially in the warpwise direction in the shoe edge abutment regions E1.

Then, as shown in FIGS. 5(D) and 9, while the mandrel M is being rotated, the yarn 32 is unreeled from one or plural bobbins 34 disposed in a yarn supply device. The yarn 32 is spirally wound around the outer circumferential surface of the grid member 30, producing the yarn-wound layer 33.

The yarn supply device has a moving device for moving the bobbin 34. The moving device moves the bobbin 34 along the axis of the mandrel M as the yarn 32 unreeled from the bobbin 34 is helically wound into the yarn-wound layer 33.

The yarn 32 of the yarn-wound layer 33 comprises a monofilament yarn, a multifilament yarn, or a twisted yarn thereof which is made of synthetic fiber having a high mechanical strength, a high modulus or a high coefficient of elasticity such as of nylon, PET, aromatic polyamide, aromatic polyimide, high-strength polyethylene, or the like.

If the yarn 32 comprises a multifilament yarn of nylon or PET (7,000 dtex (decitex)), then the yarn 32 should preferably be spirally wound in a range from 10 yarns/(5 cm) through 50 yarns/(5 cm). If the yarn 32 comprises a multifilament yarn of aromatic polyamide (3,000 dtex), the yarn 32 should preferably be spirally wound in a range from 15 yarns/(5 cm) through 60 yarns/(5 cm). The yarn 32 should preferably have a mechanical strength in a range from 100 kg/cm to 300 kg/cm.

In this manner, the base layer 22, which is disposed entirely on the outer circumferential surface of the shoe-side layer 21, is constructed. The base layer 22 has the main body 27 comprising the grid member 30, the reinforcing bases 11 comprising the grid member 30, and the yarn-wound layer 33 disposed around the outer circumferential surface of the grid members 30.

The entire outer circumferential surface of the grid members 30, which make up the main body 27 and the reinforcing bases 11 of the base layer 22, is tightened by the yarn-wound layer 33. As a result, the grid members 30 are stably positioned on the entire outer circumferential surface of the shoe-side layer 21, and the mechanical strength of the belt 4 in the warpwise direction (the MD direction) is increased.

According to the present invention, either one of the process of attaching the grid member 30 to the entire circumferential surface of the shoe-side layer 21, and the process of attaching the grid members 30 to given regions circumferentially in the warpwise direction to produce the pair of reinforcing bases 11 may be carried out first. Each of the grid members 30 may be in a single layer (one layer) or a plurality of layers.

If each of the grid members 30 is in a plurality of layers, then the portions in which the ends in the widthwise direction of the grid members overlap each other (or the portions in which the ends are spaced from each other or are held in abutment against each other) should preferably be not disposed in the same position across a plurality of layers. With this structure, the base layer 22 has no unwanted undulations.

In this manner, as shown in FIGS. 9 and 10, the base layer 22 is constructed by forming the yarn-wound layer 33 on the entire outer circumferential surface of the grid members 30. Thereafter, while the mandrel M is being rotated, the base layer 22 is coated with a resin. The resin should preferably be a resin having such a viscosity that it enters the gaps between the grid members 30 of the base layer 22 and the yarn-wound layer 33 to close and fill the gaps.

In the above embodiment, the single-layer grid member 30 is disposed around the outer circumferential surface of the shoe-side layer 21 to produce the main body 27, and the grid members 30 serving as the pair of reinforcing bases 11 are disposed on portions of the outer circumferential surface of the main body 27, after which the yarn-wound layer 33 is disposed on the entire outer circumferential surface. The base layer may rather be formed according to various methods shown below (Case 1) through (Case 4), or according to modifications and inventive examples to be described below.

(Case 1) First, a yarn-would layer 33 is formed, thereafter a grid member 30 is formed on the entire circumferential surface of the yarn-would layer 33 to form a main body 27, and then grid members 30 serving as a pair of reinforcing bases 11 are disposed circumferentially in the warpwise direction in give regions.

(Case 2) A grid member 30 disposed on the entire circumferential surface to form a main body 27 is provided in one layer or a plurality of layers, and grid members 30 serving as reinforcing bases 11 are provided in one layer or a plurality of layers.

(Case 3) First, a yarn-would layer 33 is formed, thereafter a grid member 30 is formed on the entire circumferential surface of the yarn-would layer 33 to form a main body 27, then grid members 30 are disposed circumferentially in the warpwise direction in give regions to form reinforcing bases 11, and thereafter a yarn-would layer 33 is formed.

(Case 4) A grid member 30 is disposed on the entire circumferential surface to form a main body 27, then a yarn-would layer 33 is formed, thereafter grid members 30 are disposed circumferentially in the warpwise direction in give regions to form reinforcing bases 11, and finally a yarn-would layer 33 is formed.

After the base layer 22 is formed, as shown in FIGS. 5(E), 5(F) and 10, step 3 of forming a wet paper web-side layer 25 (FIG. 3) and forming a plurality of grooves 24 each having a rectangular cross section is carried out.

The base layer 22 is impregnated with a resin for forming a wet paper web-side layer 25 on the yarn-wound layer 33. Since the resin of the wet paper web-side layer 25 reaches the outer circumferential surface of the shoe-side layer 21, the shoe-side layer 21, the wet paper web-side layer 25 and the base layer 22 are joined together into an integral assembly. For forming the wet paper web-side layer 25 of the resin, it is deposited to a predetermined thickness using a doctor bar 35. If necessary, the shoe-side layer 21 and the wet paper web-side layer 25 should preferably be joined with increased strength using a primer, an adhesive, or the like.

The shoe-side layer 21 and the wet paper web-side layer 25 are preferably made of a polyurethane resin, but may be made of rubber, elastomer, or the like. The polyurethane resin should preferably be a thermosetting urethane resin for its properties, and have a hardness in a range from 80 to 98 (JIS-A). The hardness of the shoe-side layer 21 and the hardness of the wet paper web-side layer 25 may be the same as or different from each other.

After the resin is cured with heat, the surface is polished. Thereafter, a plurality of grooves 24 are formed in the warpwise direction in the surface 23 of the wet paper web-side layer 25. In this manner, the belt 4 is formed on the surface of the mandrel M.

Thereafter, as shown in FIG. 11, the belt 4 is separated from the mandrel M using a jig 36. If the surface of the mandrel M is coated with a release agent or a release sheet is applied to the surface of the mandrel M in advance, then the belt 4 can easily be separated from the mandrel M.

At this time, an end of the belt 4 is fixed to a ring of the jig 36 which has a diameter greater than the mandrel M, and the ring is made separable from the mandrel M. In this manner, the belt 4 can easily be separated from the mandrel M.

Various modifications of the present embodiment will be described below with reference to FIGS. 12 through 15.

Figure 12:
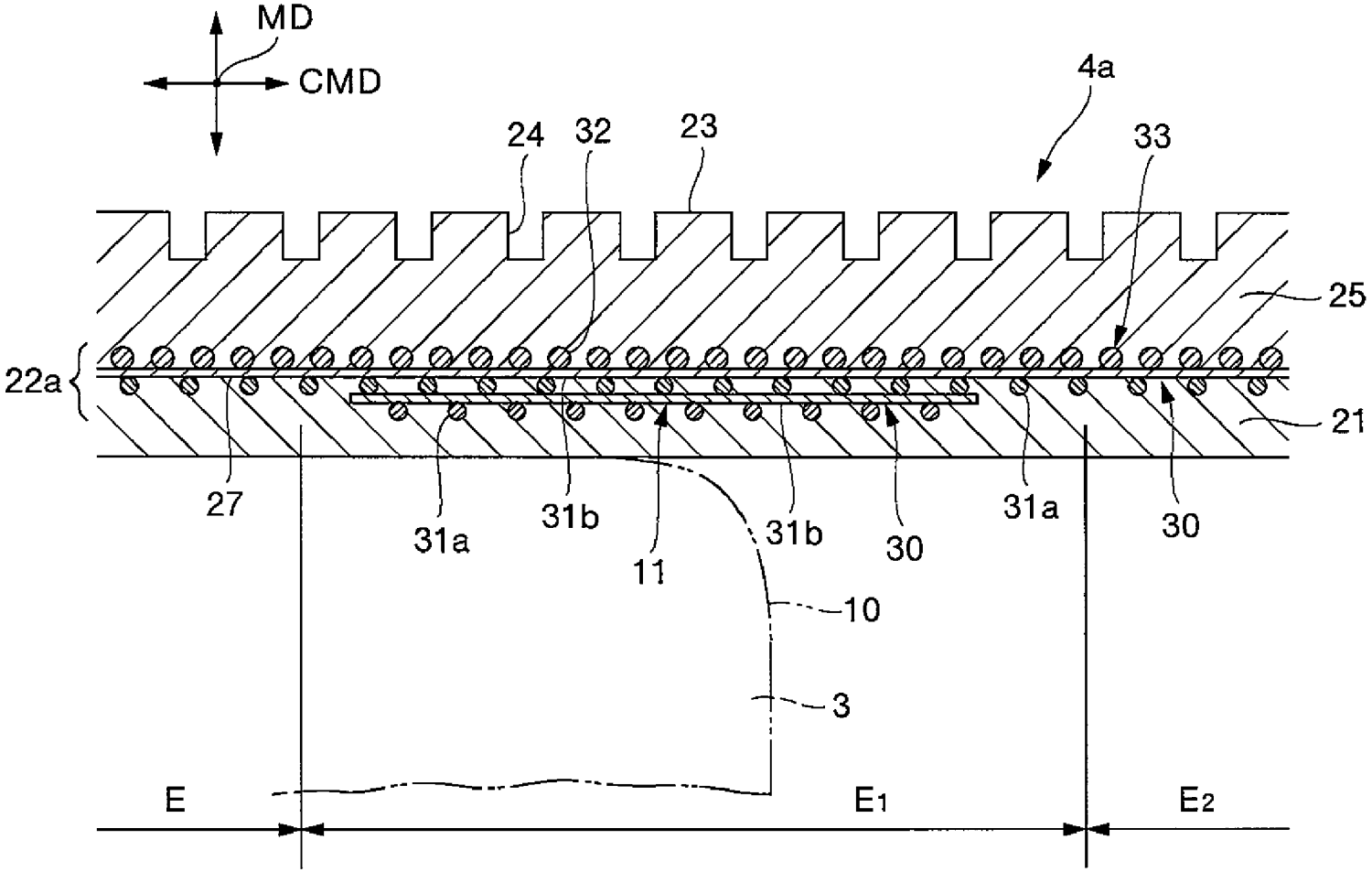
Figure 13:
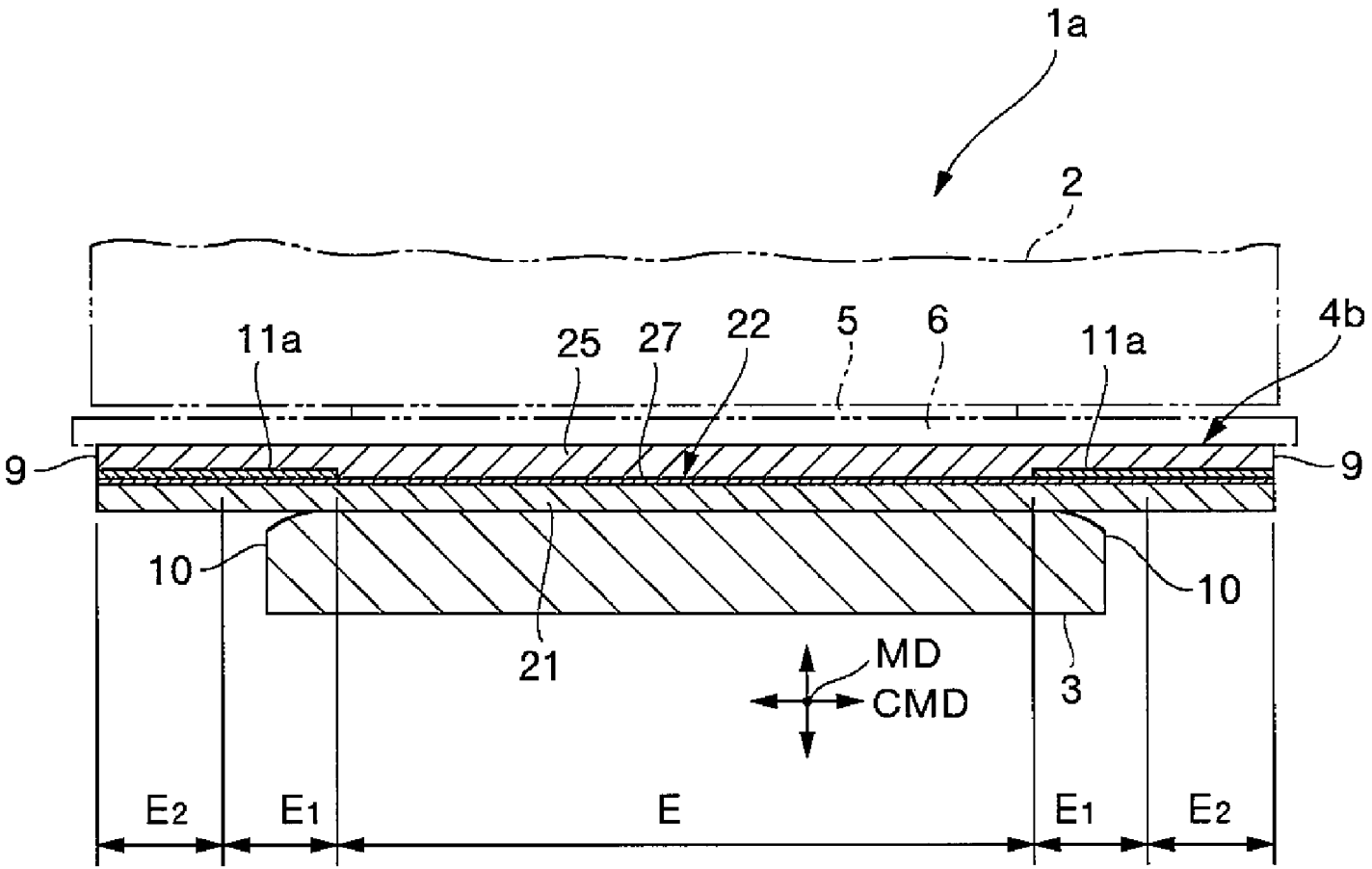
Figure 14:
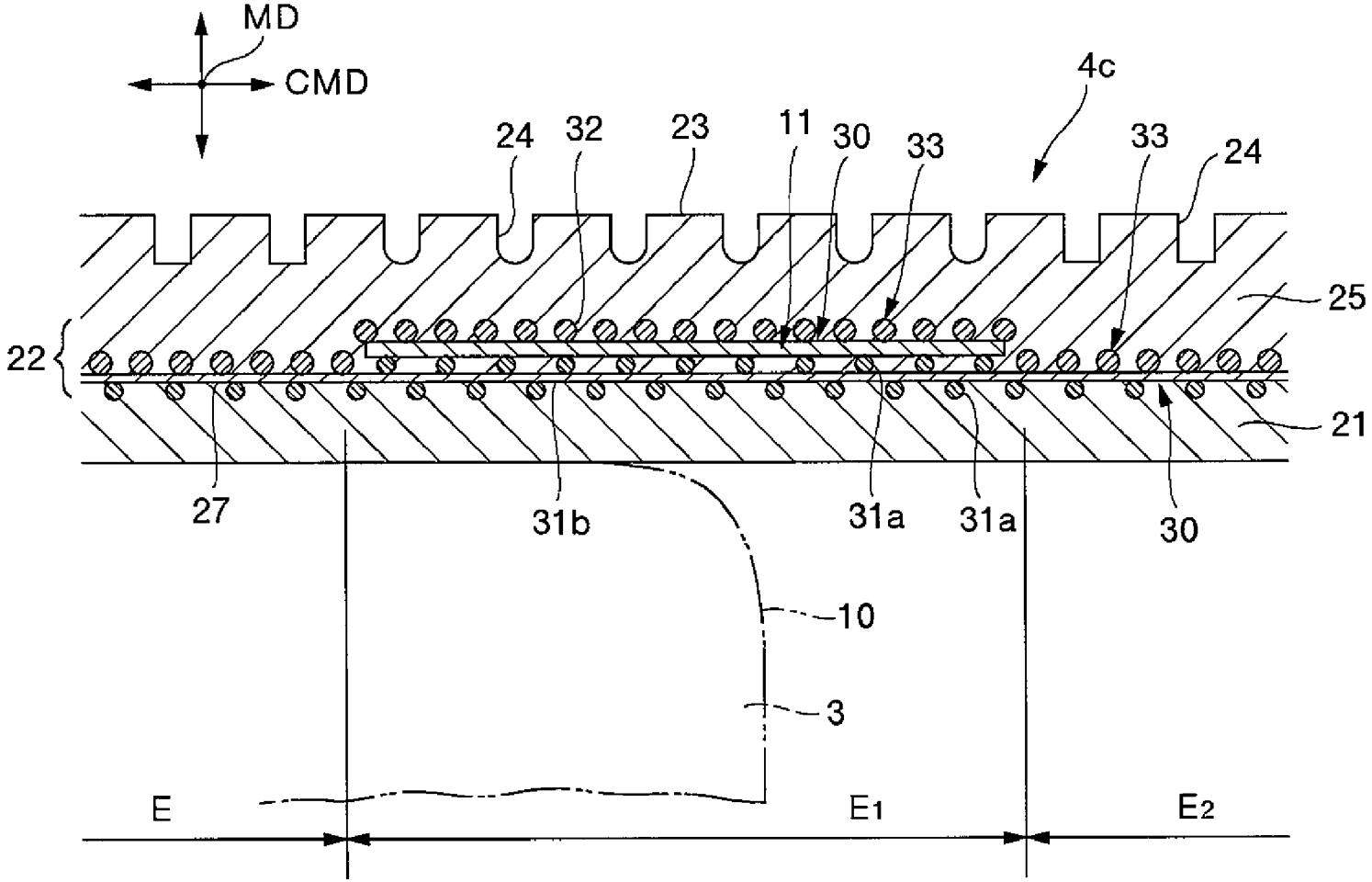
Figure 15:
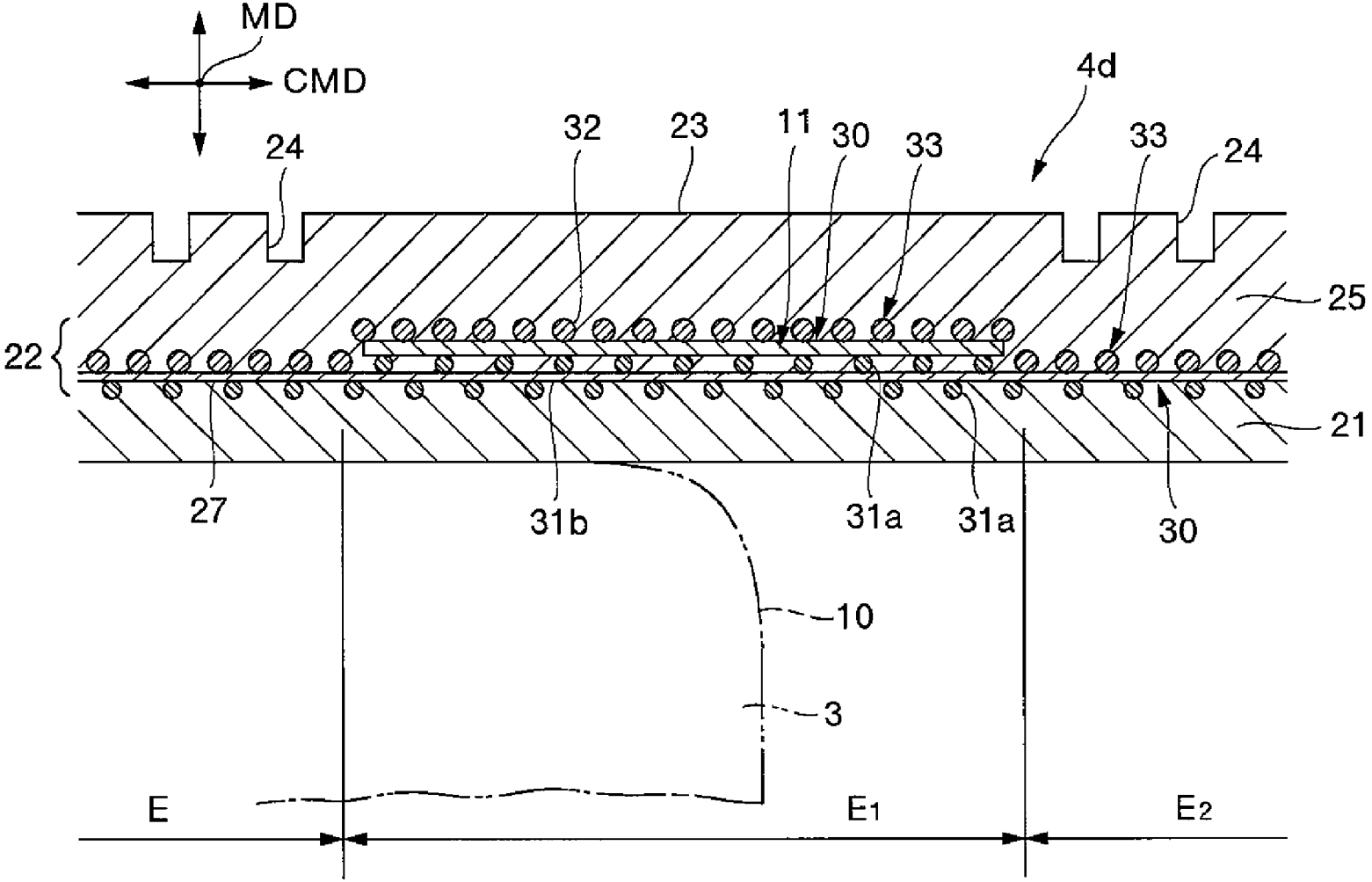

FIG. 12 is a cross-sectional view corresponding to FIG. 3, showing a belt 4*a* for a shoe press according to a first modification. FIG. 13 is a cross-sectional view corresponding to FIG. 2, showing a shoe press mechanism 1a employing a belt 4*b* for a shoe press according to a second modification. FIG. 14 is a cross-sectional view corresponding to FIG. 3, showing a belt 4*c* for a shoe press according to a third modification. FIG. 15 is a cross-sectional view corresponding to FIG. 3, showing a belt 4*d* for a shoe press according to a fourth modification.

Those parts which are identical or correspond to those according to the above embodiment are denoted by identical reference characters and will not be described below, and only different parts will be described below.

In FIGS. 12 through 15, belts 4*a* through 4*d* for a shoe press according to the first through fourth modifications are disposed for rotational movement between a press roll 2 of a shoe press mechanism and a shoe 3 below (or above) the press roll 2. The belts 4*a* through 4*d* for a shoe press comprise a shoe-side layer 21 held in contact with the shoe 3, a base layer 22 (or 22*a*) disposed on an outer circumferential surface of the shoe-side layer 21, and a wet paper web-side layer 25 disposed on an outer circumferential surface of the base layer 22 (or 22*a*). The wet paper web-side layer 25 has a plurality of grooves 24, for discharging water, which are defined in a surface 23 thereof and are extend in the warpwise direction (the MD direction).

The base layer 22 (or 22*a*) has a pair of reinforcing bases 11 (or 11*a*). The reinforcing bases 11 (or 11*a*) are disposed in given regions corresponding respectively to the shoe edges 10 on the opposite sides in the widthwise direction of the shoe 3, and extend circumferentially in the warpwise direction. The base layer 22 (or 22*a*) thus constructed operates in the same way and offers the same advantages as with the above embodiment.

In the belts 4*a* through 4*d* for a shoe press, the reinforcing bases 11, 11*a* comprise grid members 30. The base layer 22 (or 22*a*) comprises a main body 27 made up of a grid member 30, a reinforcing base 11 (or 11*a*) made up of the grid member 30, and a yarn-wound layer 33 disposed on the outer (or inner) circumferential surface of the grid member 30 and made up of a helically wound yarn 32. The base layer 22 (or 22*a*) thus constructed operates in the same way and offers the same advantages as with the above embodiment.

In the belt 4*a* for a shot press shown in FIG. 12, the reinforcing bases 11 of the base layer 22*a* are disposed on the inner circumferential surface of the base layer 22*a*. After the shoe-side layer 21 is formed, grid members 30 are disposed around the outer circumferential surface of the shoe-side layer 21 circumferentially in the warpwise direction in given regions (in the present modification, the shoe edge abutment regions E1) corresponding respectively to the shoe edges 10 on the opposite sides in the widthwise direction of the shoe 3, thereby forming the reinforcing bases 11.

In other words, before a grid member 30 serving as the main body 27 of the base layer 22*a* is placed on the entire circumferential surface of the shoe-side layer 21, other grid members 30 are placed circumferentially to form the reinforcing bases 11. In this manner, the grooves 24 in the shoe edge abutment regions E1 and the grooves in the central region E are made as deep as each other.

In the belt 4*b* for a shoe press for use in the shoe press mechanism 1*a* shown in FIG. 13, reinforcing bases 11*a* included in the base layer 22 are disposed in given regions (in the present modification, both the shoe edge abutment regions E1 and the end regions E2 including the ends 9 in the weftwise direction of the belt 4*b* for a shoe press).

With this structure, the rigidity of the belt 4*b* for a shoe press is increased in both the shoe edge abutment regions E1 and the end regions E2.

Therefore, the bending stress and crack resistance of the belt 4*b* for a shoe press are further increased in portions which extend outwardly from the shoe edges 10 on the opposite sides in the widthwise direction of the shoe 3. As a result, bending deformations are more effectively suppressed, and cracking is also prevented from occurring.

In the belt 4*c* for a shoe press shown in FIG. 14, the grooves 24 defined in the warpwise direction in the surface 23 of the wet paper web-side layer 25 have a curved (e.g., arcuate) cross-sectional shape.

If there are edges on the inner circumferential surfaces of the grooves, then bending stresses concentrate on the edges, tending to cause cracking. According to the present modification, there are no edges on the inner circumferential surfaces of the grooves 24 which are positioned near the shoe edges 10. As a consequence, even when the belt 4*c* for a shoe press is bent under shearing stresses, no bending stresses concentrate on the inner circumferential surfaces of the grooves 24. Therefore, the belt 4*c* has further increased crack resistance.

In the belt 4*c* for a shoe press, of the grooves 24 defined in the belt 4*c*, the grooves 24 which are positioned near the shoe edges 10 are of a curved cross-sectional shape. However, all the grooves 24 may be of a curved cross-sectional shape.

In the belt 4*d* for a shoe press shown in FIG. 15, the grooves 24 are defined in the warpwise direction in the surface of the wet paper web-side layer 25. The grooves 24 are not defined in the shoe edge abutment regions E1 on the opposite sides in the widthwise direction of the shoe 3, but are defined in other portions than the shoe edge abutment regions E1.

Since the belt 4*d* for a shoe press is driven to rotate as the press roll 2 is actuated, its bending deformation becomes greatest in the vicinity of the shoe edges 10. The belt 4*d* for a shoe press has no grooves 24 in the vicinity of the shoe edges 10. Therefore, in the vicinity of the shoe edges 10, no crack is caused in grooves and the rigidity is increased. The belt 4*d* for a shoe press thus has increased durability.

Although no grooves 24 are defined in the vicinity of the shoe edges 10, as no wet paper web is disposed in those regions, the function to discharge water is not adversely affected, and no problem arises with respect to the water squeezing capability of the shoe press mechanism.

INVENTIVE EXAMPLES

Specific inventive examples 1 through 5 and comparative example 1 of the belts for a shoe press according to the present invention which are constructed as described above were produced.

Inventive Example 1

Step 1: The polished surface of a mandrel having a diameter of 1,500 mm, rotatable by a drive means, was coated with a release agent (KS-61: manufactured by Shin-Etsu Chemical Co., Ltd.) in advance. Then, while the mandrel was being rotated, the surface of the mandrel was coated with a thermosetting urethane resin to a thickness of 1 mm, using a doctor bar. The mandrel was then left to stand at the room temperature for 10 minutes.

The thermosetting urethane resin comprised a mixture of a TDI prepolymer (TAKENATE L2395 [manufactured by Takeda Pharmaceutical Co., Ltd.]) and a curing agent containing DMTDA (ETHACURE 300 [manufactured by Albemarle Corp.]) with an H/NCO equivalent ratio of 0.97. ETHACURE 300 is a mixture of 3,5-dimethylthio2,4-toluenediamine and 3,5-dimethylthio2,6-toluenediamine.

Then, the thermosetting urethane resin was cured by being heated at 70° C. for 30 minutes by a heating device attached to the mandrel, forming a shoe-side layer.

Step 2: A grid member (a weft density of 4 yarns/cm and a warp density of 1 yarn/cm) was prepared. The grid member was made of weft yarns comprising twisted multifilament yarns of PET fiber having 5,000 dtex and warp yarns comprising twisted multifilament yarns of PET fiber having 500 dtex. The warp yarns were sandwiched by the weft yarns, with crossings of the warp and weft yarns being filled by an urethane resin adhesive.

A plurality of webs of the grid member were placed in one layer around the entire outer circumferential surface of the shoe-side layer such that the weft yarns extend along the axis of the mandrel and the webs of the grid member have widthwise ends held in abutment against each other, thereby forming a main body of a base layer.

Grid members were further placed around the outer circumferential surface of the grid member, forming reinforcing bases. The grid members serving as the reinforcing bases were of a structure different from the grid member serving as the main body of the base layer. Specifically, the grid members serving as the reinforcing bases were made of weft and warp yarns comprising twisted multifilament yarns of PET fiber having 500 dtex. The warp yarns were sandwiched by the weft yarns, with crossings of the warp and weft yarns being filled by an urethane resin adhesive. Each of the weft density and the warp density was 4.5 yarns/cm.

The grid members were wound twice circumferentially in the warpwise direction. Specifically, the grid members were wound in two layers in the direction in which the mandrel is rotated and placed in only the shoe edge abutment regions E1 of the belt, such that the weft yarns of the grid members extend along the axis of the mandrel. In this manner, reinforcing bases of the base layer were formed.

Then, multifilament yarns of PET fiber having 7,000 dtex were spirally wound at a pitch of 30 yarns/5 cm around the outer circumferential surface of the grid members so that a yarn-wound layer is formed. Thereafter, the yarn-wound layer was coated with a resin such that the resin enters and closes the gaps between the grid members of the base layer and the yarn-wound layer, thereby completing the base layer.

Step 3: The yarn-wound layer of the base layer was impregnated and coated with a thermosetting urethane resin, which was used as the resin of the shoe-side layer, to a thickness of 5.5 mm. The thermosetting urethane resin was then cured by being heated at 100° C. for 5 hours, thereby forming a wet paper web-side layer.

Thereafter, the surface of the wet paper web-side layer was polished to adjust the entire thickness of the belt to about 5.0 mm. Then, grooves having a rectangular cross section were formed in the belt in the warpwise direction (the MD direction) by a rotary blade, thereby forming a belt for a shoe press according to the present invention.

Inventive Example 2

In step 2 according to inventive example 1, a plurality of webs of the grid member (of the same material of the grid member serving as the main body of the base layer in step 2 according to inventive example 1) were placed in one layer around the entire outer circumferential surface of the shoe-side layer such that the weft yarns extend along the axis of the mandrel and the webs of the grid member have widthwise ends held in abutment against each other, thereby forming a main body of a base layer.

Grid members were further placed around the outer circumferential surface of the grid member, forming reinforcing bases. The grid members serving as the reinforcing bases were of a structure different from the grid member serving as the main body of the base layer. Specifically, the grid members serving as the reinforcing bases were made of weft and warp yarns comprising twisted multifilament yarns of PET fiber having 500 dtex. The warp yarns were sandwiched by the weft yarns, with crossings of the warp and weft yarns being filled by an urethane resin adhesive. Each of the weft density and the warp density was 4.5 yarns/cm.

The grid members were wound twice circumferentially in the warpwise direction. Specifically, the grid members were wound in two layers in the direction in which the mandrel is rotated and placed in both the shoe edge abutment regions E1 and the end regions E2 of the belt, such that the weft yarns of the grid members extend along the axis of the mandrel. In this manner, reinforcing bases were formed. Then, a yarn-wound layer was formed on the outer circumferential surface of the reinforcing bases in the same manner as with step 2 according to inventive example 1, thereby completing the base layer.

In step 2 according to inventive example 2, a plurality of webs of the grid member may be placed in two layers around the outer circumferential surface of the shoe-side layer such that the weft yarns extend along the axis of the mandrel and the webs of the grid member have widthwise ends overlapping each other, thereby forming a main body of a base layer.

Inventive Example 3

In step 2 according to inventive example 1, a yarn is spirally wound around the outer circumferential surface of the shoe-side layer. Thereafter, one web of the grid member (of the same material of the grid member serving as the main body of the base layer in step 2 according to inventive example 1) was placed in one layer such that the web of the grid member has widthwise ends held in abutment against each other, thereby forming a main body of a base layer.

Grid members were further placed around the outer circumferential surface of the grid member, forming reinforcing bases. The grid members serving as the reinforcing bases were of a structure different from the grid member serving as the main body of the base layer. Specifically, the grid members serving as the reinforcing bases were made of weft and warp yarns comprising twisted multifilament yarns of PET fiber having 500 dtex. The warp yarns were sandwiched by the weft yarns, with crossings of the warp and weft yarns being filled by an urethane resin adhesive. Each of the weft density and the warp density was 4.5 yarns/cm.

The grid members were wound twice circumferentially in the warpwise direction. Specifically, the grid members were wound in two layers in the direction in which the mandrel is rotated and placed in only the shoe edge abutment regions E1 of the belt, such that the weft yarns of the grid members extend along the axis of the mandrel. In this manner, reinforcing bases were formed. Then, a yarn-wound layer was formed on the outer circumferential surface of the reinforcing bases, thereby completing the base layer.

Inventive Example 4

In step 2 according to inventive example 1, a yarn is spirally wound around the outer circumferential surface of the shoe-side layer. Thereafter, one web of the grid member (of the same material of the grid member serving as the main body of the base layer in step 2 according to inventive example 1) was placed in one layer such that the web of the grid member has widthwise ends held in abutment against each other, thereby forming a main body of a base layer.

Grid members were further placed around the outer circumferential surface of the grid member, forming reinforcing bases. The grid members serving as the reinforcing bases were of a structure different from the grid member serving as the main body of the base layer. Specifically, the grid members serving as the reinforcing bases were made of weft and warp yarns comprising twisted multifilament yarns of PET fiber having 500 dtex. The warp yarns were sandwiched by the weft yarns, with crossings of the warp and weft yarns being filled by an urethane resin adhesive. Each of the weft density and the warp density was 4.5 yarns/cm.

The grid members were wound twice circumferentially in the warpwise direction. Specifically, the grid members were wound in two layers in the direction in which the mandrel is rotated and placed in both the shoe edge abutment regions E1 and the end regions E2 of the belt, such that the weft yarns of the grid members extend along the axis of the mandrel. In this manner, reinforcing bases were formed. Then, a yarn-wound layer was formed on the outer circumferential surface of the reinforcing bases, thereby completing the base layer.

Inventive example 5

In step 3 according to inventive example 1, grooves having a substantially rectangular shape and groove bottoms of an arcuate cross-sectional shape were formed in the warpwise direction (the MD direction) of the belt by a rotary blade, thereby forming a belt for a shoe press according to the present invention.

Comparative Example 1

In step 2 according to inventive example 1, a plurality of webs of the grid member were placed around the outer circumferential surface of the shoe-side layer. Specifically, the grid member was placed in one layer around the outer circumferential surface of the shoe-side layer such that the weft yarns extend along the axis of the mandrel and the webs of the grid member have widthwise ends held in abutment against each other. Then, a yarn-wound layer was formed around the outer circumferential surface, thereby forming a base layer. The belt for a shoe press according to comparative example 1 has no reinforcing bases.

Table 1 shown below indicate crack resistance and bending stresses of the belts for a shoe press according to inventive examples 1 through 6 and comparative example 1.

[Evaluation of Physical Properties]

Figure 17:
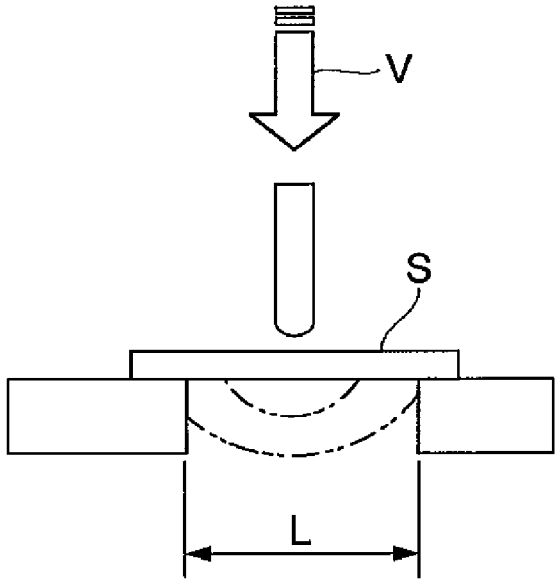

Samples of the belts for a shoe press thus constructed were measured for physical properties to obtain the data shown in Table 1. The samples were extracted in rectangular shapes such that the boundary between the shoe edge abutment regions E1 and the end regions E2 was positioned substantially centrally in the samples, and the rectangular samples were used as objects to be measured for physical properties. Crack resistance and bending stresses (rigidity) were measured according to the following method:

(2) Bending Stresses (Evaluation of Rigidity):

FIG. 17 is a schematic view of an experimental apparatus for checking bending stresses. Bending stresses were measured and rigidity was evaluated using the experimental apparatus.

Bending stresses (forces for deforming a belt in the shoe edge abutment regions) in the thicknesswise direction of a belt for a shoe press were measured by a three-point bending measurement process shown in FIG. 17. A sample S of the belt for a shoe press had a plurality of grooves extending perpendicularly to the sheet of FIG. 17, and directions perpendicular to the grooves are shown as left and right directions in FIG. 17.

Test conditions are as follows:

Size of the sample S: 150 mm×25 mm

Distance L between supports: 50 mm

Speed V at which to press the center of the sample: 50 mm/min.

TABLE 1

| | Inv. Ex. 1 | Inv. Ex. 2 | Inv. Ex. 3 | Inv. Ex. 4 | Inv. Ex. 5 | Com. Ex. 1 |
|---|---|---|---|---|---|---|
| Thickness (mm) | 5.0 | 5.2 | 5.0 | 5.2 | 5.0 | 5.0 |
| Hardness (JIS-A) | 93 | 93 | 93 | 93 | 93 | 93 |
| MD cutting Strength (kg/cm) | 220 | 230 | 220 | 230 | 220 | 220 |
| CD cutting Strength (kg/cm) | 120 | 140 | 120 | 140 | 120 | 100 |
| Crack resistance-number of times sample was pressed until cracked (ten thousand) | 70~80 | >100 | 60~70 | >100 | >100 | 30~40 |
| Bending stresses (kg/cm) | 6.9 | 8.9 | 5.9 | 7.3 | 6.9 | 3.5 |

Figure 16:
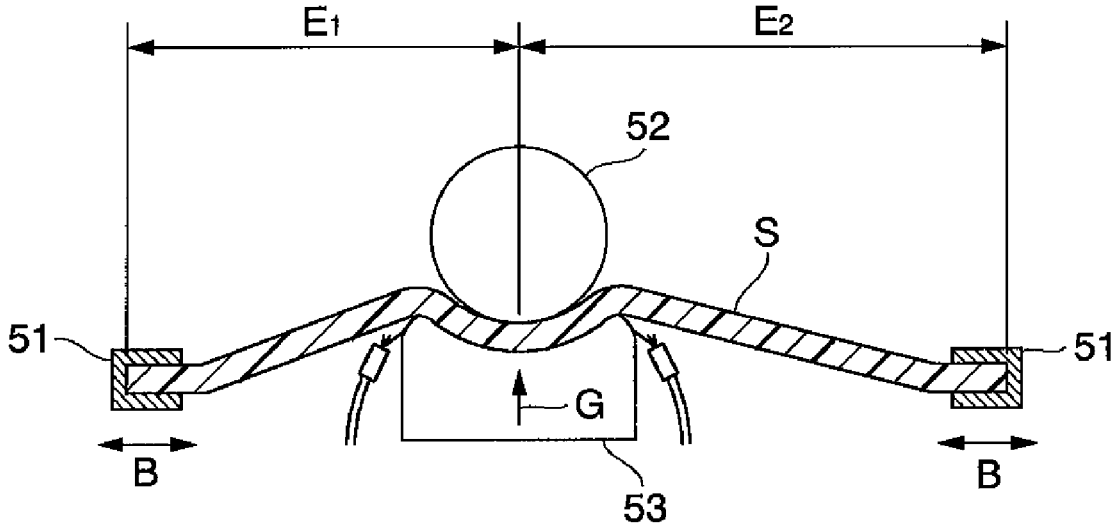

(1) Crack Resistance:

FIG. 16 is a schematic view of an experimental apparatus for checking crack resistance (shown in Table 1) and wear property (shown in Table 2).

For measuring crack resistance using the experimental apparatus, a sample S of the belt for a shoe press was produced by cutting the belt for a shoe press in a transverse direction (a direction perpendicular to the grooves), and both ends of the sample S were secured by clamp hands 51, 51 (FIG. 16).

The sample S is sandwiched between a rotary roll 52 and a press shoe 53, and has an outer circumferential surface held in contact with the rotary roll 52. The press shoe 53 is moved in the direction of the rotary roll 52 as indicated by the arrow G, pressing the sample S under a pressure of 36 kg/cm$^2$.

With the ends of the sample S being clamped by the respective clamp hands 51, 51, the clamp hands 51, 51 are reciprocated to the left and right as indicated by the arrows B in ganged relation to each other. The sample S is kept under a tension of 3 kg/cm and is reciprocated at a speed of 40 cm/second.

The length of the sample S is adjusted such that both the shoe edge abutment regions E1 and the end regions E2 are held against the rotary roll 52 while the sample S is being reciprocated.

Using the experimental device, the sample S was repeatedly reciprocated, and the number of times that the sample S was reciprocated until the bottoms and edges of the grooves of the sample S cracked. Thereafter, the surfaces of ridges positioned between the grooves in the outer circumferential surface of the sample S were observed for the occurrence of hair cracks.

As can be seen from Table 1, the samples S according to inventive examples 1 through 5 have better crack resistance and bending stresses than the sample according to comparative example 1.

According to the present invention, the base layer including the reinforcing bases employs grid members 30. The wear property of the grid members 30 is measured by the experimental device (FIG. 16), and the results are shown in Table 2.

The experimental device shown in FIG. 16 imparts a strong bend to the sample S toward the press shoe 53, causing stresses due to the bend at the crossings of the weft yarns and the warp yarns of the grid member. The sample S includes the grid member and the yarn-wound layer near the rotary roll 52, and stresses due to the bend in the grid member and the yarn-wound layer are not so large. The experimental device is capable of checking the degree of wear on the crossings of the weft yarns and the warp yarns of the grid member.

Using the experimental device, inventive examples 1a through 3a and comparative example 1a were experimented up to a reciprocating count of 500,000, and were measured for cutting strengths in the warpwise and weftwise directions of the samples S after the experiment to observe the wear properties of the grid members of the samples S. The samples S were subjected to a tension of 3 kg/cm, a pressure of 36 kg/cm$^2$, and moved at a speed of 40 cm/second.

The cutting strengths of inventive examples 1a through 3a and comparative example 1a and the wear properties of the grid members thereof are shown in Table 2.

TABLE 2

| | Grid member warp yarns | Grid member weft yarns | Rate of change of tensile stress after experiment (warpwise direction) | Rate of change of tensile stress after experiment (weftwise direction) | Observation of wear property of grid members |
|---|---|---|---|---|---|
| Inv. Ex. 1a | Spun yarns of polyester cotton with 5000 dtex (one yarn/cm) | Twisted multifilament yarns of polyester with 5000 dtex (four yarns/cm) | 30% | 80% | Warp yarn wear (large) Weft yarn wear (small) |
| Inv. Ex. 2a | Spun yarns of cotton with 5000 dtex (one yarn/cm) | Spun yarns of polyester cotton with 5000 dtex (four yarns/cm) | 20% | 90% | Warp yarn wear (large) Weft yarn wear (small) |
| Inv. Ex. 3a | Twisted multifilament yarns of polyester with 500 dtex (one yarn/cm) | Twisted multifilament yarns of polyester with 1000 dtex (four yarns/cm) | 40% | 60% | Warp yarn wear (medium) Weft yarn wear (medium) |
| Com. Ex. 1a | Twisted multifilament yarns of polyester with 1000 dtex (one yarn/cm) | Twisted multifilament yarns of polyester with 1000 dtex (four yarns/cm) | 70% | 30% | Warp yarn wear (small) Weft yarn wear (large) |

※ Rate of change of tensile stresses after experiment - the cutting strength measured by INSTRON tensile tester ※ Rate of change (%) = (cutting strength after experiment/cutting strength before experiment) × 100

It can be seen from Table 2 that since the weft yarns of the grid members according to inventive examples 1a through 3*a* are less liable to wear than the warp yarns, the wear resistance of the weft yarns is better than with comparative example 1a.

In the grid members according to inventive examples 1a through 3a, the warp yarns which cross the weft yarns are more likely to wear than the weft yarns, the warp yarns are caused to wear preferentially when the samples S are bent to cause wear on the crossings of the weft and warp yarns during the experiment. As a result, damage to the weft yarns is reduced, keeping the cutting strength thereof to maintain dimensional stability in the weftwise direction (the CMD direction) of the belt for a shoe press.

As described above, the grid members 30 used in the base layer are less rigid and softer than woven fabrics because the grid members 30 are not woven. Accordingly, the belt for a shoe press which employs the grid members 30 in the base layer is flexible when it is driven to rotate as the press roll 2 is actuated. Particularly, bending deformations of the belt portions in the shoe edge abutment regions E1 are the greatest.

In the belts 4, 4*a* through 4*d* for a shoe press according to the present invention, the reinforcing bases 11, ha are disposed in only the shoe edge abutment regions E1 or both the shoe edge abutment regions E1 and the end regions E2, providing the base layers 22, 22*a*.

In the base layers 22, 22*a*, therefore, the rigidity of portions in which greatest bending deformations are likely to occur (belt portions in the shoe edge abutment regions E1) is partially increased.

As a consequence, the bending stresses of the belts 4, 4*a* through 4*d* for a shoe press are increased to suppress bending deformations, and the crack resistance is increased to prevent cracking, so that the belts 4, 4*a* through 4*d* for a shoe press are increased in durability.

While the embodiments (including modifications and inventive examples) have been described above, the present invention is not limited to the above embodiments, but various changes and additions may be made within the scope of the invention.

Identical reference characters denote identical or corresponding parts throughout views.

INDUSTRIAL APPLICABILITY

The belt for a shoe press according to the present invention is applicable to a shoe press mechanism of a papermaking machine, particularly a press-sleeve-type shoe press mechanism.

The invention claimed is:

1. A belt (4, 4*a* through 4*d*) for a shoe press, which is adapted to be disposed for rotational movement between a press roll (2) of a shoe press mechanism (1, 1*a*) and a shoe (3) above or below the press roll (2), said belt (4, 4*a* through 4*d*) for a shoe press comprising:

a shoe-side layer (21) held in contact with said shoe (3), a base layer (22, 22*a*) disposed on an outer circumferential surface of said shoe-side layer (21), and a wet paper web-side layer (25) disposed on an outer circumferential surface of said base layer (22, 22*a*);

wherein said base layer (22, 22*a*) have a pair of reinforcing bases (11, 11 *a*), and said reinforcing bases (11, 11*a*) are disposed circumferentially in a warpwise direction in given regions corresponding respectively to shoe edges (10) on the opposite sides in a widthwise direction of said shoe (3), and wherein said reinforcing bases (11) are disposed in only shoe edge abutment regions (E1) held in abutment against said shoe edges (10) of the belt (4, 4*a*, 4*c*, 4*d*) for a shoe press.

2. A belt (4, 4*a* through 4*d*) for a shoe press, which is adapted to be disposed for rotational movement between a press roll (2) of a shoe press mechanism (1, 1*a*) and a shoe (3) above or below the press roll (2), said belt (4, 4*a* through 4*d*) for a shoe press comprising:

a shoe side layer (21) held in contact with said shoe (3), a base layer (22, 22*a*) disposed on an outer circumferential surface of said shoe-side layer (21) and a wet paper web-side layer (25) disposed on an outer circumferential surface of said base layer (22, 22*a*);

wherein said base layer (22, 22*a*) have a pair of reinforcing bases (11, 11*a*), and said reinforcing bases (11, 11*a*) are disposed circumferentially in a warpwise direction in given regions corresponding respectively to show edges (10) on the opposite sides in a widthwise direction of said shoe (3), and wherein said reinforcing bases (11*a*) are disposed in both shoe edge abutment regions (E1) held in abutment against said shoe edges (10) of the belt (4*b*) for a shoe press and end regions (E2) including ends (9) in a weftwise direction of the belt (4*b*) for a shoe press.

3. A belt for a shoe press according to claim 1 or 2, wherein said reinforcing bases (11, 11*a*) are disposed on one or both of the outer and inner circumferential surfaces of said base layer (22, 22*a*).

4. A belt for a shoe press according to claim 1 or 2, wherein said wet paper web-side layer (25) has a plurality of grooves (24) defined in the warpwise direction in a surface thereof, and said grooves (24) have a curved cross-sectional shape.

5. A belt for a shoe press according to claim 4,wherein of said grooves (24) defined in the belt (4*c*), the grooves (24) positioned in the vicinity of said shoe edges (10) have a curved cross-sectional shape, or all said grooves (24) have a curved cross-sectional shape.

6. A belt for a shoe press according to claim 1 or 2, wherein a plurality of grooves (24) defined in the warpwise direction in the surface of said wet paper web-side layer (25) of the belt (4*d*) are not defined in the shoe edge abutment regions (E1) on the opposite sides in the widthwise direction of said shoe (3), but are defined in portions other than the regions (E1).

7. A belt for a shoe press according to claim 1 or 2, wherein said reinforcing bases (11, 11*a*) comprise grid members (30) made up of warp yarns (31*a*) and weft yarns (31*b*) arranged in a grid pattern and joined to each other at crossings (31*c*), and wherein said base layer (22, 22*a*) comprises, a main body (27) comprising a grid member (30) made up of warp yarns (31*a*) and weft yarns (31*b*) arranged in a grid pattern and joined to each other at crossings (31*c*), said reinforcing bases (11, 11*a*) comprising said grid members (30), and a yarn-wound layer (33) disposed on an outer or inner circumferential surface of said grid members (30) and made up of a helically wound yarn (32).

8. A belt for a shoe press according to claim 7,wherein said reinforcing bases (11, 11*a*) employ grid members (30) which are identical to or different from the grid member of said main body (27) of said base layer (22).

9. A belt for a shoe press according to claim 8, wherein said grid member (30) of said main body (27) and said grid members (30) of said reinforcing base (11) are different from each other in a first case wherein said grid members (30) have different meshes, a second case wherein said grid members (30) have warp yarns (31*a*) of different thicknesses, a third case wherein said grid members (30) have weft yarns (31*b*) of different thicknesses, and a combination of two or all of the first through third cases.

10. A belt for a shoe press according to claim 7, wherein said grid members (30) are disposed in a plurality of layers, and portions, in which the ends in the widthwise direction of the grid members (30) overlap each other, or portions, in which the ends are spaced from each other or are held in abutment against each other, are not disposed in the same position across the layers.

11. A belt for a shoe press according to claim 7, wherein said weft yarns (31*b*) of said grid members (30) are less liable to wear than said warp yarns (31*a*) thereof.

12. A belt for a shoe press according to claim 11, wherein said warp yarns (31*a*) comprise twisted yarns or spun yarns made of inorganic fiber such as carbon fiber, glass fiber, or the like, or natural fiber such as cotton, or synthetic fiber, and said weft yarns (31*b*) comprise twisted yarns of synthetic fiber having a high modulus and a high coefficient of elasticity such as of nylon, polyethylene terephthalate, aromatic polyamide, aromatic polyimide, high-strength polyethylene, or the like, or polyester multifilament, or spun yarns of polyester cotton.

13. A belt for a shoe press according to claim 12, wherein said synthetic fiber is made of polyester cotton, polyester multifilament, acrylic cotton, or acrylic multifilament.

* * * * *